United States Patent [19]

Arakawa et al.

[11] Patent Number: 4,660,871

[45] Date of Patent: Apr. 28, 1987

[54] CAM GROOVE LATCH DEVICE

[75] Inventors: Masaru Arakawa; Yoshio Kaneko, both of Chigasaki, Japan

[73] Assignee: Nifco, Inc., Yokohama, Japan

[21] Appl. No.: 843,106

[22] Filed: Mar. 24, 1986

[30] Foreign Application Priority Data

Apr. 1, 1985 [JP] Japan ..... 60-46834[U]

[51] Int. Cl.[4] ..... E05C 19/02

[52] U.S. Cl. ..... 292/81; 292/198; 292/DIG. 4; 292/DIG. 61; 292/DIG. 72

[58] Field of Search ..... 292/DIG. 4, DIG. 38, 292/DIG. 72, 5, 6, 10, 19, 129, 170, 181, 191, 192, 198, DIG. 61, 81, 252; 24/645, 654, 656, 662

[56] References Cited

U.S. PATENT DOCUMENTS 4,383,707 5/1983 Nishimura ..... 292/110
4,482,175 11/1984 Sugie ..... 292/45
4,538,844 9/1985 Watanabe ..... 292/127

FOREIGN PATENT DOCUMENTS 60-11977 1/1985 Japan .
208163 4/1940 Switzerland ..... 292/DIG. 4

*Primary Examiner*—Robert L. Wolfe
*Assistant Examiner*—Lloyd A. Gall
*Attorney, Agent, or Firm*—Trexler, Bushnell, Giangiorgi & Blackstone, Ltd.

[57] ABSTRACT

A latch device comprises a casing secured to a body with a door hinged thereto and a slide to be pushed, when the door is closed, by a strike projecting from the back side of the door into the casing so that the door is held closed with the strike retained in the slide. The slide has a heart-shaped cam groove formed in the top surface. A latch pin is provided with its one end received in the cam groove and its other end rotatably fitted in the casing. The one end of the latch pin is adapted to trace the cam groove with the movement of the slide, and is urged against the bottom of the cam groove by a retainer spring.

3 Claims, 8 Drawing Figures

CAM GROOVE LATCH DEVICE

FIELD OF THE INVENTION AND RELATED ART STATEMENT

This invention relates to a latch device and, more particularly, to a pop-out latch device which can lock a hinged door in closed state and permits the door to be opened by once pushing the door and then releasing it.

A latch device having such functions is disclosed in Japanese Utility Model Public Disclosure SHO 51(1976)129190. In this latch device, a slide is slidably inserted in a casing and has a heart-shaped cam groove formed on the surface, and a latch pin having one end received in the cam groove and the other end fitted in the casing is adapted to trace the cam groove with the movement of the slide.

In this prior art latch device, however, the latch pin merely has its one bent end received in the cam groove and its other bent end fitted in a pin hole formed in the casing. Therefore, the latch pin is liable to be turned to the left or right in the cam groove or pop up from the cam groove due to such causes as vibration produced when opening and closing the door. In such a case, the cam groove cannot be traced accurately. Therefore, the latch device cannot operate smoothly or provide reliable locking. The reliability of the device, therefore, is inferior.

In the latch device which utilizes a cam groove for locking a slide, it is desired that a latch pin reliably trace the cam groove without possibility of movement in undesired directions in the cam groove when the slide is in motion or stationary.

SUMMARY AND OBJECT OF THE INVENTION

An object of the invention is to provide a latch device, which permits smooth movement of various parts, can provide reliable locking and has high reliability.

With the latch device according to the invention, which has a slide slidably inserted in a casing and having a heart-shaped cam groove formed on the surface and a latch pin having one end fitted in the casing and the other end received in the cam groove for tracing the cam groove with the movement of the slide, the latch pin is urged against the bottom of the cam groove by a retainer spring, and spring means is accommodated in the casing such that it is compressed between a rear end wall of the casing and the slide.

Thus, with the latch device according to the invention, in which the latch pin is urged at all times against the bottom of the cam groove by the retainer spring, one end of the cam groove can be accurately traced at all times by one end of the latch pin.

More specifically, to close the door, a strike projecting from the back side of the door pushes the slide into the casing against the spring force of the spring means. With the displacement of the cam groove with the movement of the slide, one end of the latch pin traces the cam groove to a stop section thereof. As a result, the slide is locked with respect to the casing. In this state, the latch device locks the door in a closed state with the strike of the door retained in the slide.

To open the door, it is only necessary to push the door again. When the door in the closed state is pushed, the slide is pushed in slightly by the strike. At this time, the cam groove is displaced relative to the latch pin with a movement of the slide, so that the latch pin is detached from the stop section of the cam groove.

Now, the slide is pushed out of the casing by the spring force of the spring means. The slide is subsequently locked against movement when the latch pin comes to the starting position after one circuit of the cam groove. At this position, the slide pushes the strike to push open the door slightly. The door in this state can be opened widely by pulling it.

The above and other objects and features of the invention will become more apparent from the following description with reference to the accompanying drawings.

DETAILED DESCRIPTION OF THE PREFERRED EMBODIMENT

Figure 1:
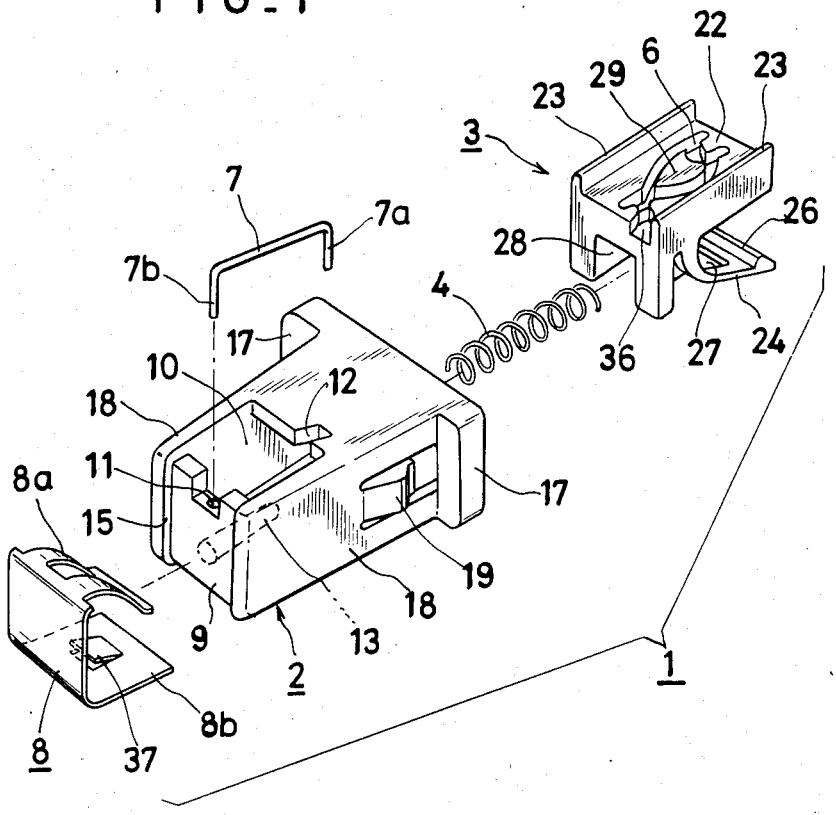
FIG. 1 is an exploded perspective view showing an embodiment of the latch device according to the invention.

The drawings illustrate an embodiment of the latch device according to the invention. The latch device 1 comprises a stationary casing 2 closed at one end and open at the other end and a slide 3 slidable in the stationary casing 2. Both members are plastic moldings.

The slide 3 is biased toward open end 5 of the casing 2 by the biasing force of a coil spring 4 which is accommodated in the casing 2. The slide 3 has a top surface formed with a heart-shaped cam groove 6. A latch pin 7 attached to the casing 2 has one end **7*a* received in the cam groove 6. The latch pin 7 is urged toward the bottom of the cam groove 6 by a retainer spring 8**.

The casing 2 is rectangular and open at one end. Its top has a rectangular opening 10 formed adjacent to a rear end wall 9. The top of the rear end wall 9 has a central recess. A bore 11 is formed at the bottom of the recess. The other end **7*b* of the latch pin 7 is fitted in the bore 11. The front edge of the opening 10 is formed with notch 12 extending obliquely forwardly from it. The latch pin 7 can be inserted into the casing 2 through the notch 12**.

The rear end wall 9 of the casing 2 has a pin-like projection 13 projecting forwardly from a lower portion of its inner surface. One end portion of the coil spring 4 is fitted on the projection 13. The casing 2 has a shallow guide groove 15 formed continuously in the top and outer surfaces of the rear end wall 9 and the lower surface of a bottom wall 14. The retainer spring 8 has a channel-shaped sectional profile, and it can be fitted on the casing 2 sidewise along the guide groove 15. The part of the lower surface of the bottom wall 14 constituting the guide groove 15 is formed with a rectangular latch opening 16.

The casing 2 has left and right flange portions 17 projecting outwardly from the opposite sides adjacent to the open end. The opposite side walls 18 of the casing 2 have latch or lock pawls 19 having outwardly projecting free ends toward the rear surfaces of the flange portions 17. The distance between the free end of the lock pawls 19 and the rear surface of the flange portions 17 is selected to substantially match the thickness of a body 20 on which the casing 2 is to be mounted. The body 20 has an opening 21 having the same shape as the profile of the rear end of the casing 2. By inserting the casing 2 from the rear end thereof into the opening 21, the body 20 can be easily mounted between the free end of the lock pawls 19 and the rear surface of the flange portion 17.

The slide 3 has a flat base portion 22, the top surface of which is formed with the heart-like cam groove 6. The slide 3 also has rail-like ribs 23 extending upwardly adjacent to its opposite sides. The slide 3 further has a pawl-like thin retainer 24 extending slantedly downwardly from a longitudinally intermediate portion of the lower surface of the base portion 22. The retainer 24 has a wedge-shaped engaging projection 26 formed at its end for engaging with a strike 25 of the door. The retainer 24 has a rectangular notch 27 formed in its stem portion. The slide 3 has an accommodation frame portion 28 integral with the underside of the base portion 22 and open at the rear end and bottom. The other end of the coil spring 4 is inserted into the accommodation frame portion 28 through the open end thereof.

Figure 2:
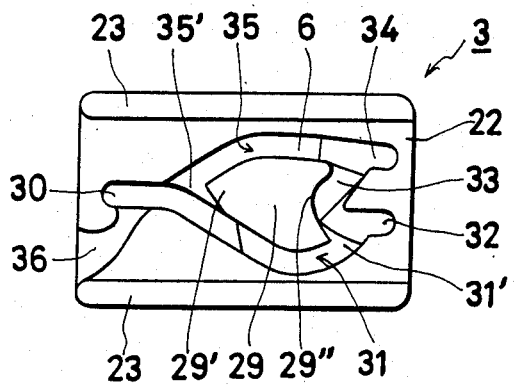
FIG. 2 is a plan view showing a slide of the latch device shown in FIG. 1.
Figure 3:
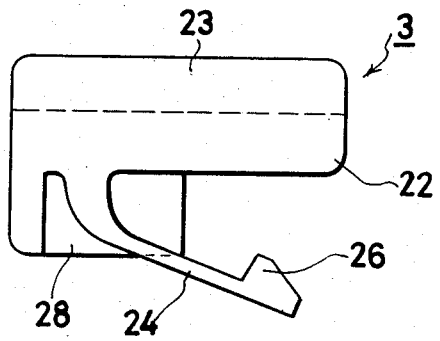
FIG. 3 is a side view showing the slide.
Figure 4:
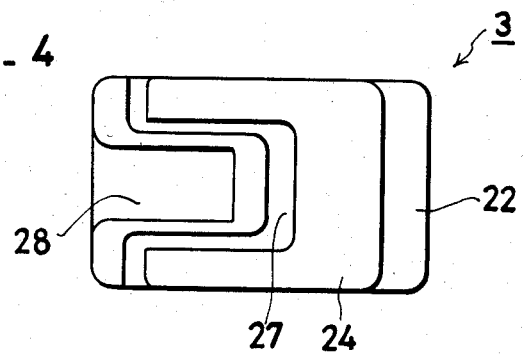
FIG. 4 is a bottom view showing the slide.
Figure 5:
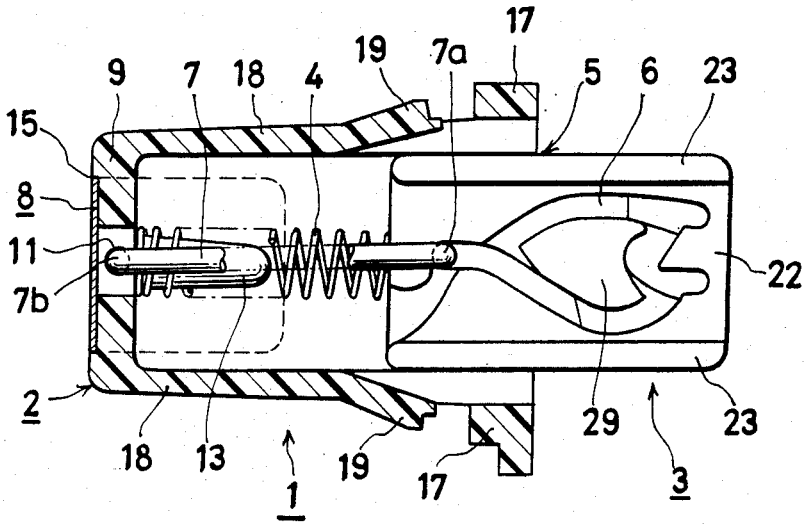
FIG. 5 is a plan sectional view showing the latch device of FIG. 1 in an unlocked state.
Figure 6:
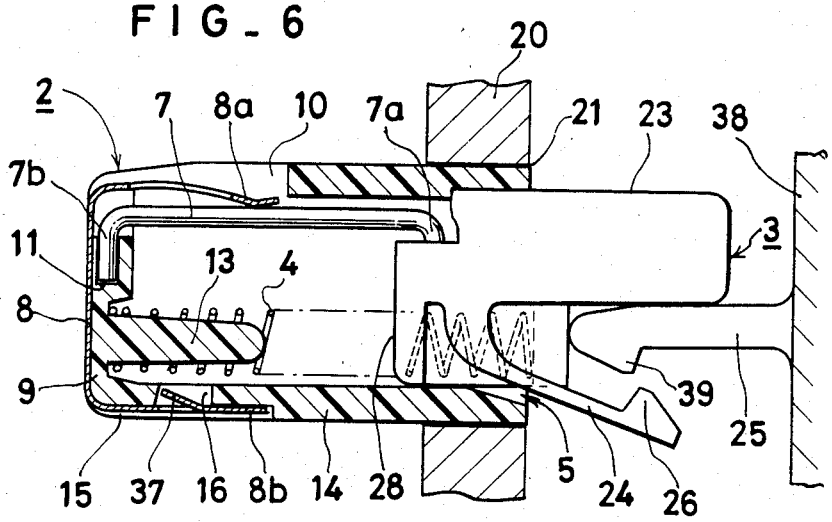
FIG. 6 is a side sectional view showing the latch device of FIG. 1 in an unlocked state.
Figure 7:
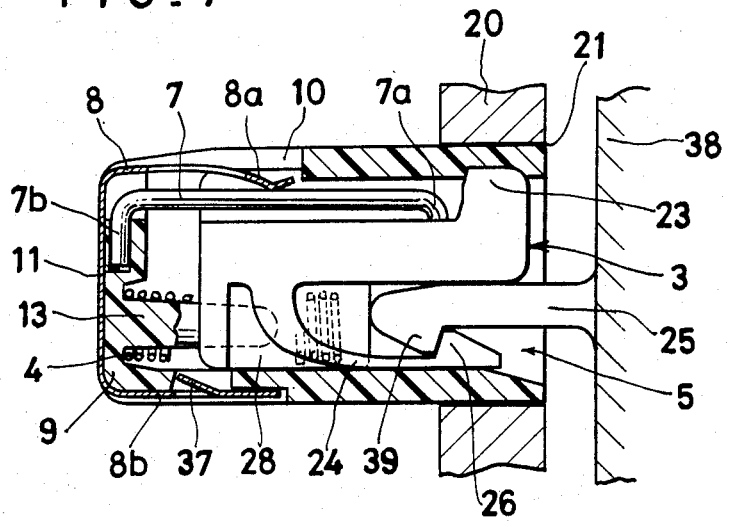
FIG. 7 is a side sectional view showing the latch device of FIG. 1 in the locked state.
Figure 8:
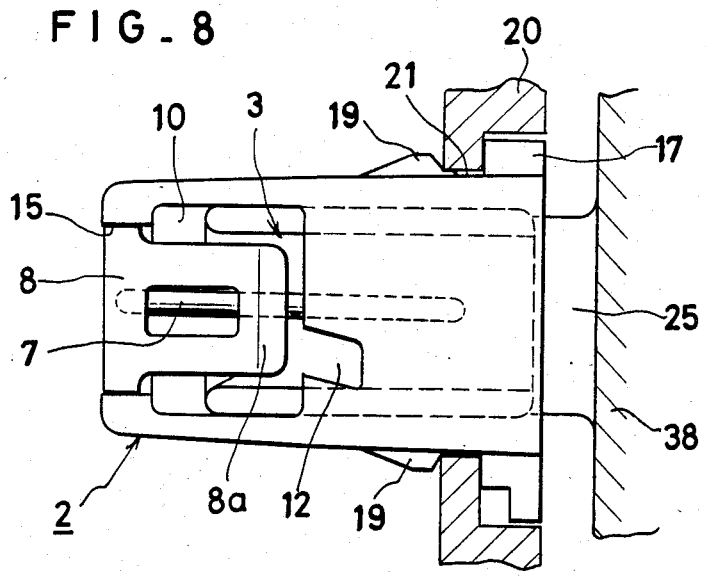
FIG. 8 is a plan view showing the latch device of FIG. 1 in the locked state.

The cam groove 6 is formed to surround a heart-like island 29. As shown in FIG. 2, it has a deep path section 30 extending from a pointed end 29' of the heart-like island 29 and having a dead end. Extending from the other end of the deep path section 30 is a forward path section 31 which extends along one side of the heart-like island 29 and becomes progressively shallower. Extending from the shallowest end 31' of the forward path section 31 is a deep end section 32 having a bent short path and a dead end. Adjacent to the end section 32, a stop section 33 extends along the concave edge 29'' of the heart-like island 29 and is slightly deeper than the stop section 33. Adjacent to the stop section 33 is an escapement section 34 which is deeper than the stop section 33 and extends toward the other side of the heart-like island 29. Extending from the other end of the escapement section 34 is a backward path section 35 which extends along the other side of the heart-like island 29 and becomes progressively shallower toward a shallowest end 35' communicating with the deep path section 30. A shallow guide groove 36 is provided such that it communicates at one end with the deep path section 30. The other end of the guide groove 36 flares and is open at the rear end of the slide 3. The latch pin 7 can be inserted into the cam groove 6 along the guide groove 36.

The latch pin 7 which is received in the cam groove 6 is made of a metal and has opposite short bent end portions **7*a* and 7*b* extending in the same direction. The end 7*a* is received in the cam groove 6 of the slide 3, while the other end 7*b* is fitted in the bore 11 formed in the casing 2. Thus, with displacement of the cam groove 6 relative to the latch pin 7 caused by the movement of the slide 3, the cam groove 6 swings to the left and right with respect to the other end 7*b* of the latch pin 7. During this time, the end 7*a* of the latch pin 7 executes one circuit of the cam groove 6. The opposite bent end portions of the latch pin 7 have the same length and extend in the same direction, so that either one of them may be inserted in either the cam groove 6 or the bore 11**. This is advantageous from the standpoint of ease in assembly.

In this embodiment, the retainer spring 8 is formed separately from the casing 2 by bending opposite end portions of a metal sheet to extend in the same direction. The retainer spring 8 has an upper end portion **8*a* having a reduced width. It also has a lower end portion 8*b* having a pawl portion 37** having an inwardly projecting end.

The retainer spring 8 is fitted sidewise on the casing 2 along the guide groove 15 after the slide 3, coil spring 4 and latch pin 7 have been installed in the casing 2. As the retainer spring 8 is fitted, its upper end portion or flange **8*a* is brought into contact with the latch pin 7 through the opening 10 of the casing 2, whereby the latch pin 7 is urged downwardly toward the bottom of the cam groove 6 by the spring force of the retainer spring 8. Also, the pawl portion 37 of the lower end portion 8*b* of the retainer spring 8 is fitted in the opening 16 of the casing 2, and the free end of the pawl 37 engages with the edge of the opening 16. The retainer spring 8 is thus retained against detachment. Since the upper end portion 8*a* of the retainer spring 8 has a reduced width, in a case where the upper end portion 8*a* is upwardly pushed by the latch pin 7, only the upper end portion 8*a* is upwardly flexed. Thus, there is no possibility of the whole retainer spring 8 being flexed and detached from the guide groove 15**.

The latch device 1 having the above construction is secured to the body 20 which may be a cabinet. The strike 25 projects from the back surface of a door 38 which is hinged to the body 20. The strike 25 has a wedge-shaped projection 39 formed at its free end. The strike 25 and the retainer 24 are hooked on each other when the projection 39 of the former and the engaging projection 26 of the latter engage with each other.

When closing the door 38 by using the latch device described above, it is only necessary to push the door 38 toward the body 20 with the hand. When the door 38 is pushed the slide 3 is pushed into the casing 2 against the spring force of the coil spring 4 by the end of the strike 25 projecting from the back side of the door. As a result, the retainer 24 of the slide 3 is brought into engagement with the edge of the end opening 5 of the casing 2 and is flexed by this edge as it enters the casing through the end opening 5. The slide 3 thus proceeds into the casing 2 with the strike 25 clamped between the lower surface of its base portion 22 and its retainer 24.

With the progress of the slide 3, the cam groove 6 is displaced relative to the latch pin 7. The end **7*a* of the latch pin 7 thus proceeds along the deep path section 6 to go over to the forward path section 31 and then go from the shallowest end 31' thereof over to the deep end section 32 where it can no longer proceed. This state is set to correspond to a slight overshoot of the door 38 beyond the closed state thereof. Upon closing the door 38, the user can feel a click produced at the end of the end section 32, and at this moment the pushing force is released. As a result, the slide 3 is slightly pushed out by the restoring force of the compressed coil spring 4. The door 38 thus is slightly pushed back, and the end 7*a* of the latch pin 7 proceeds backwards along the end section 32**.

The end section 32 is bent with respect to the shallowest end 31' of the forward path section 31, and the end section 32 is deeper than the forward path section 31. Therefore, the end **7*a* of the latch pin 7 having proceeded backwards can no longer return to the forward path section 31 and goes over the slightly deeper stop section 33 adjacent to the inlet of the end section 32. In this state, the restoring force of the coil spring 4 is received by the concave edge 29" of the heart-like island 29. More specifically, when the door 38 is released after it has been pushed slightly beyond the closed position until a click is felt, it is brought back to the position to close the opening of the body by the restoring force of the compressed coil spring 4. The door 38 is thus locked in the closed state with the mutually pulling engagement between the engaging projection of the retainer 24 and projection 39 of the strike 25**.

To open the door 38 from the closed state, it is only necessary to push the door 38 again with hand. When this is done, the slide 3 is pushed by the strike 25 projecting from the back side of the door 38. The cam groove 6 thus is displaced relative to the latch pin 7 with the movement of the slide 3. At this time, the end 7*a* of the latch pin 7 which is now in the stop section 33 which is deeper than the end section 32 of the cam groove 6, cannot return to the end section 32, so that it goes over to the escapement section 34, which is shallower than the stop section 33. With the door 38 released by the hand, the slide 3 is caused to proceed toward the open end 5 of the casing 2 by the restoring force of the coil spring 4. Thus, the end 7*a* of the latch pin 7 moves out from the escapement section 34 to the backward path section 35 to go through the shallowest end 35' of the backward path section 35 to the deep path section 30. The restoring force of the coil spring 4 is thus received by the dead end of the deep path section 30. More specifically, when the door 38 is released after it has been pushed slightly beyond the closed state, the slide 3 is pushed back toward the open end 5 of the casing 2 by the restoring force of the compressed coil spring 4. Thus, when the retainer 24 of the slide 3 clears the opening 5, it is outwardly flexed to release the strike 25. At this moment, the strike 25 is slightly pushed back by the slide 3 so that the door 38 is opened slightly. The door 38 now can be freely opened by gripping it directly or by a handle secured thereto.

In the embodiment as described above, the cam groove 6 is formed in the top surface of the slide 3, while the accommodation frame portion 28 in contact with the end of the coil spring 4 is provided integrally with the lower surface of the base portion 22 of the slide 3. Thus, the vertical space of the slide can be effectively utilized to reduce the depth of the interior of the casing 2, which is advantageous for size reduction of the entire latch device.

In the above embodiment, the retainer spring 8 is a metal spring provided separately of the casing 2. However, this is by no means limitative, and it is possible to use a plastic spring in lieu of the metal spring or to provide a retainer for urging latch pin 7 which is integral with the casing 2. Further, the relation between the latch 1 and strike 25 in the above embodiment is by no means limitative, for example, it is possible to arrange for the strike 25 to be clamped vertically or laterally.

As has been described in the foregoing, according to the invention the latch pin 7 is urged against the bottom of the cam groove 6 by the retainer spring 8. Thus the end of the latch pin 7 can reliably follow the bottom level of the cam groove 6, and it is possible to prevent turning down or popping up of the latch pin 7. The latch device 1 thus can operate smoothly and provide reliable locking. It is thus possible to provide a highly reliable latch device.

What is claimed is:

1. A latch device comprising: a casing secured to a body with a door hinged thereto; a slide, spring means bearing on said slide and urging said slide outwardly of said casing; a strike projecting from the back side of the door and pushing said slide into said casing against the spring force of said spring means when the door is closed so that the door is held closed with the strike retained in said slide, said slide having a heart-shaped cam groove; a substantially U-shaped latch pin having a bight and a pair of parallel legs extending therefrom in the same direction, said latch pin having one leg received in said cam groove and the other leg rotatably fitted in said casing, said latch pin being caused to trace said cam groove with the movement of said slide in said casing; and a retainer spring bearing against said bight of said substantially U-shaped pin for urging said latch pin against the bottom of said cam groove, said retainer spring being a sheet metal substantially channel-shaped spring having a web and a pair of flanges extending from opposite ends of said web in substantially the same direction, said retainer spring substantially embracing an end of said casing, one of said flanges being at an acute angle to said web and bearing against said bight of said pin.

2. The latch device according to claim 1, wherein said spring means is provided between a rear end wall of said casing and said slide and biases said slide toward an open end of said casing at all times.

3. The latch device according to claim 1, wherein said slide has a retainer extending slantedly downwardly from its lower surface for engaging said strike.

* * * * *